US011002501B2

(12) United States Patent
Barrett

(10) Patent No.: US 11,002,501 B2
(45) Date of Patent: May 11, 2021

(54) AMMUNITION RETAINING FEED TRAY

(71) Applicant: WHG Properties, LLC, North Wales, PA (US)

(72) Inventor: Ronnie Barrett, Murfreesboro, TN (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 16/179,514

(22) Filed: Nov. 2, 2018

(65) Prior Publication Data

US 2019/0339032 A1 Nov. 7, 2019

Related U.S. Application Data

(60) Provisional application No. 62/581,771, filed on Nov. 5, 2017.

(51) Int. Cl.
*F41A 9/29* (2006.01)
*F41A 3/66* (2006.01)

(52) U.S. Cl.
CPC . *F41A 9/29* (2013.01); *F41A 3/66* (2013.01)

(58) Field of Classification Search
CPC ..... F41A 9/29; F41A 9/32; F41A 9/33
See application file for complete search history.

(56) References Cited

U.S. PATENT DOCUMENTS

| | | | | | |
|---|---|---|---|---|---|
| 1,541,282 | A * | 6/1925 | Russell | F41A 9/34 | 89/33.14 |
| 2,367,488 | A * | 1/1945 | Dobremysl | 89/33.2 | |
| 3,955,469 | A * | 5/1976 | Conley | F41A 9/32 | 89/33.14 |
| 3,960,053 | A * | 6/1976 | Conley | F41A 3/70 | 89/149 |
| 2008/0216375 | A1* | 9/2008 | Barrett | F41A 3/66 | 42/16 |
| 2016/0305725 | A1* | 10/2016 | Patel | F41A 9/37 | |
| 2020/0200496 | A1* | 6/2020 | Franssen | F41A 9/32 | |

FOREIGN PATENT DOCUMENTS

| | | | | |
|---|---|---|---|---|
| CA | 2317084 | A1 * | 2/2002 | F41A 33/00 |
| GB | 1138423 | A * | 1/1969 | F41A 9/32 |

* cited by examiner

*Primary Examiner* — Gabriel J. Klein
(74) *Attorney, Agent, or Firm* — Fox Rothschild LLP

(57) ABSTRACT

An ammunition retaining feed tray for a firearm including a feed tray with a distal and a proximal end, a cartridge stop for alignment of an ammunition belt, at least one pawl opening, and a pawl assembly engagement; a pawl assembly connected to the pawl assembly engagement of the feed tray with the pawl assembly including at least one pawl operable to move within the at least one pawl opening of the feed tray and for engaging an ammunition belt.

20 Claims, 11 Drawing Sheets

AMMUNITION RETAINING FEED TRAY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to an ammunition retaining feed tray for a firearm. More particularly, the invention pertains to an ammunition retaining feed tray for a belt-fed firearm such as the M240 machine gun, so as to improve loading of the firearm. Optionally, a pawl assembly may be utilized with the feed tray to retain an ammunition belt in position while a user performs steps to load the firearm. In some optional embodiments, the pawl assembly may have two pawls to contact cartridges within an ammunition belt on each side of the linkage of the ammunition belt. In further optional embodiments, a pawl assembly may provide for pawls to be in either an upward or downward position.

One very popular belt-fed firearm is the M240 machine gun. The M240 machine gun has generally been used by the United States military since at least about the late 1970s. Currently, the firearm has multiple applications, being used by both infantry as well as with vehicles, both on land and on water. In use, the M240 machine gun is often fired from an integrated bipod or from a mount that may be attached to a vehicle or a fixed location. Some embodiments allow for an M240 machine gun to be more easily filed while held by a user. The firearm is very reliable and relatively standardized among the NATO countries.

A variety of other belt-fed firearms are utilized throughout the world. For many of these belt-fed firearms, a top cover assembly must be opened, then the ammunition belt must be properly positioned for the firearm to function with minimal malfunctions. Specifically, the individual cartridges of the ammunition belt must be properly aligned so that upon firing the firearm, the ammunition belt smoothly feeds through the firearm while each cartridge is fired. However, in loading a belt-fed firearm, often a user must hold and maintain the ammunition belt in the proper, aligned position and then subsequently close the top cover or cover assembly of the firearm. In doing so, a user generally must use two hands, one hand to hold the ammunition belt in place and the other hand to manipulate the top cover into the proper position for the firearm to function. Unless careful manipulation is performed, the user risks the ammunition belt becoming misaligned within the firearm and thus not functioning properly, or alternatively, the ammunition belt slipping off of the feed tray of the firearm.

What therefore is desired, is a feed tray for a firearm which can improve the loading of such firearm to minimize malfunctions and misalignments when loading the firearm. Specifically, what is desired is an device and method for retaining an ammunition belt on the feed tray of a firearm in proper alignment while loading the firearm.

BRIEF SUMMARY OF THE INVENTION

As used herein, "proximal" refers to a longitudinal direction which would be closer to the buttstock of the firearm or the end of the receiver that would be nearer the user's firing shoulder, and "distal" refers to a longitudinal direction closer to the muzzle of the firearm or away from the end of the receiver that would be nearer the user's firing shoulder. The proximal side of the feed tray would be the side closer to the buttstock of the firearm while the distal side of the feed tray would be the side closer to the muzzle of the firearm.

Also, as used herein, M240 refers to the family of belt-fed, gas operated machine guns which generally fire the 7.62×51 mm NATO cartridge. Further as used herein, the term "M240" is generally synonymous with the Belgian FN MAG58 machine gun and is used to include variants. Variants of the M240 machine gun may include the M240B, M240C, M240D, M240G, M240H, M240L, M240E1 and E5, M240L, and M240LW as well as the M240LWS. While discussions of various optional embodiments may describe specific variants of the M240 machine gun, the use of "M240" is intended to include all variants so long as feasible, including when also present in the claims. Also, to the extent semi-automatic versions and/or single shot variants of the M240 machine gun exist, the use of "M240" is intended to include these variants so long as feasible.

One particular M240 machine gun is the M240LW machine gun, designed by Barrett Firearms Manufacturing. Generally, the M240LW is a M240 machine gun which uses a unitary first shell and a unitary second shell to create the receiver for the firearm. Such firearm is described in U.S. Pat. No. 7,937,877, issued to Christopher Gene Barrett and entitled "Light Weight Firearm and Method of Manufacturing." U.S. Pat. No. 7,937,877 is incorporated by reference in its entirety to the extent that language from the reference does not conflict with the present disclosure.

Other belt-fed machine guns include but are not limited to the M249, M60, RPD, M2 Browning, PKM, HK21, HK23, and the M1919 machine gun. Other, additional belt-fed machine guns may include variants of the above described list of machine guns as well as semiautomatic versions of such belt-fed machine guns.

As used herein, the term "belt-fed firearm" is used to refer to a firearm that utilizes an ammunition belt for supplying cartridges to the firearm. Generally, ammunition belts are employed to feed automatic firearms such as machine guns, though in variants of firearms, ammunition belts may be used in semi-automatics firearms. Furthermore, the term ammunition belt refers to a series of cartridges with linking between the cartridges to maintain each cartridge adjacent to the next cartridge. A variety of different ammunition belts exist, including both disintegrating and non-disintegrating belts.

In accordance with one optional aspect, an ammunition retaining feed tray for a firearm is provided with a feed tray including a distal end and a proximal end, a cartridge stop for alignment of an ammunition belt, at least one pawl opening, and a pawl assembly engagement, as well as a pawl assembly connected to the pawl engagement of the feed tray with the pawl assembly including at least one pawl operable to move within the at least one pawl opening of the feed tray for engaging an ammunition belt.

In accordance with another optional aspect, an ammunition retaining feed tray may include two pawl openings and the at least one pawl may include two pawls.

In accordance with other optional aspects, the feed tray may be used with an M240 machine gun.

In other optional aspects, the pawl assembly may be connected to the feed tray at the pawl assembly engagement with the pawl assembly pin.

In accordance with another option aspect, the pawl assembly of the ammunition retaining feed tray may further include a pawl assembly pin and biasing member.

In accordance with yet further optional aspects, at least one pawl of the pawl assembly may have a partially curved side. The partially curved side may have a radius of curvature between about 0.15 inches and about 0.3 inches.

In accordance with yet further optional aspects, the pawl assembly may have two pawls spaced less than three inches apart.

In accordance with another optional aspect, a belt-fed firearm may include a receiver, a cover assembly and feed tray with a distal end, a proximal end, at least one pawl opening with the cover assembly and feed tray both connected to the receiver, with a pawl assembly adjacent to the ammunition feed tray, also with a pawl assembly having at least one pawl operable to move within the at least one pawl opening of the feed tray.

In accordance with other optional aspects, the belt-fed firearm may include two pawls and two pawl openings within the feed tray. The pawls may be operable between a downward position and an upward position.

In other optional aspects, the belt-fed firearm may include a pin and biasing member used with the pawl assembly whereby the pawls and at least a portion of the assembly may be rotatable around the pawl assembly pin.

In yet further optional aspects, the spacing between two different pawls may be from about 1.2 inches to about 1.6 inches.

In other optional embodiments, the belt-fed firearm may be an M240 machine gun. Optionally, the belt-fed firearm may be a M240 machine gun having a receiver formed from shell parts.

In accordance with another optional aspect, a method of loading a belt-fed firearm is provided comprising the steps of opening a top cover of a belt-fed firearm, locating the feed tray of the belt-fed firearm, the feed tray having two pawl openings and a pawl assembly with the pawls in an upward position, the feed tray also including a cartridge stop; placing an ammunition belt on the feed tray with a cartridge adjacent to the cartridge stop and with linkage of the ammunition belt positioned between the upward pawls with the pawls extending into the space between adjacent cartridges; and then closing the cover assembly of the belt-fed firearm.

The term "providing," and forms thereof, are used in a broad sense, and are referred to, but are not limited to making available for use, enabling usage, giving, supplying, obtaining, getting hold of, acquiring, making ready for use, and/or placing into position ready for use.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of the specification. The drawings illustrate optional embodiments of the invention and together with the description serve to explain some principles of the invention.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawings and in the description referring to the same or like parts.

DETAILED DESCRIPTION

Figure 1:
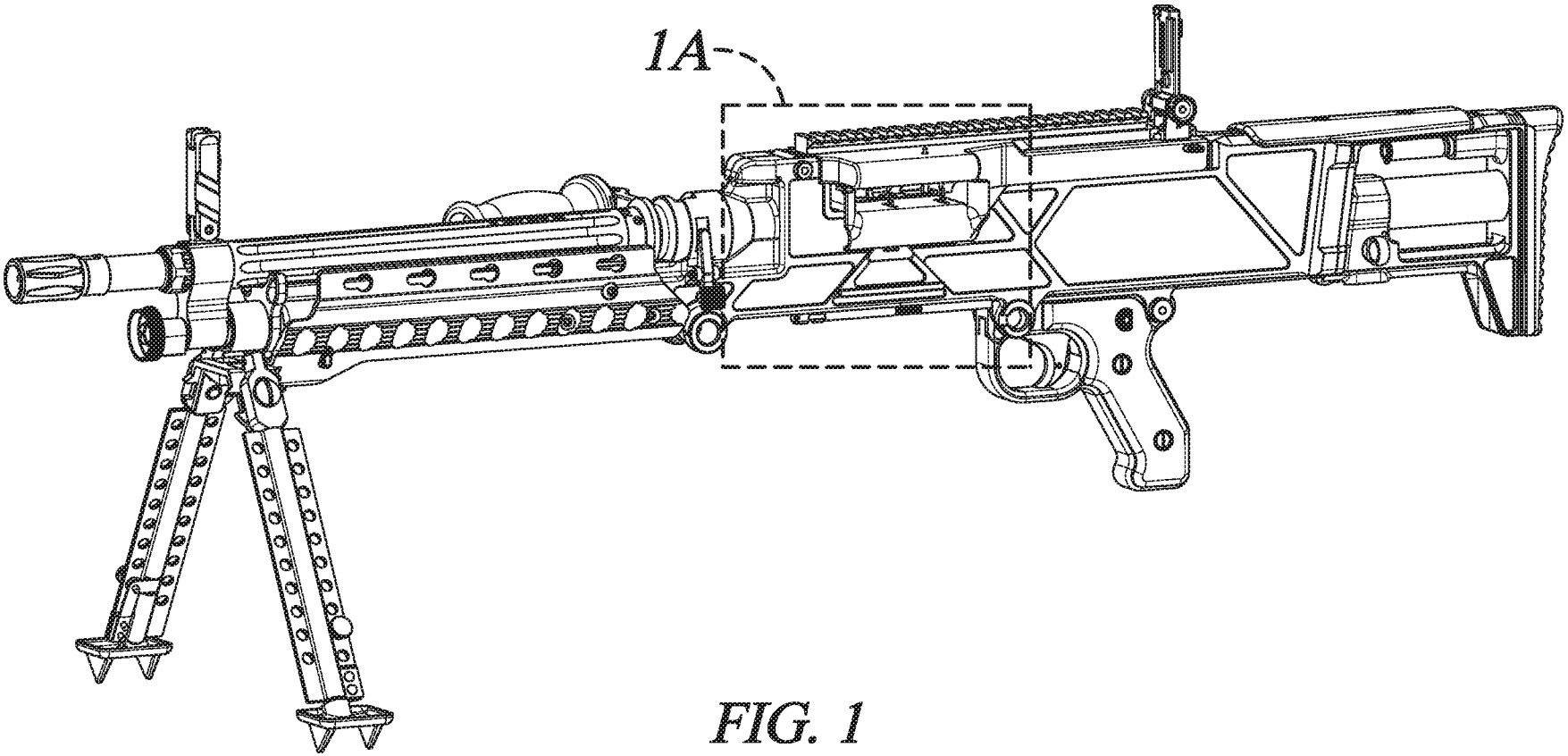
FIG. 1 is an illustration of an ammunition retaining feed tray on a firearm
Figure 1A:
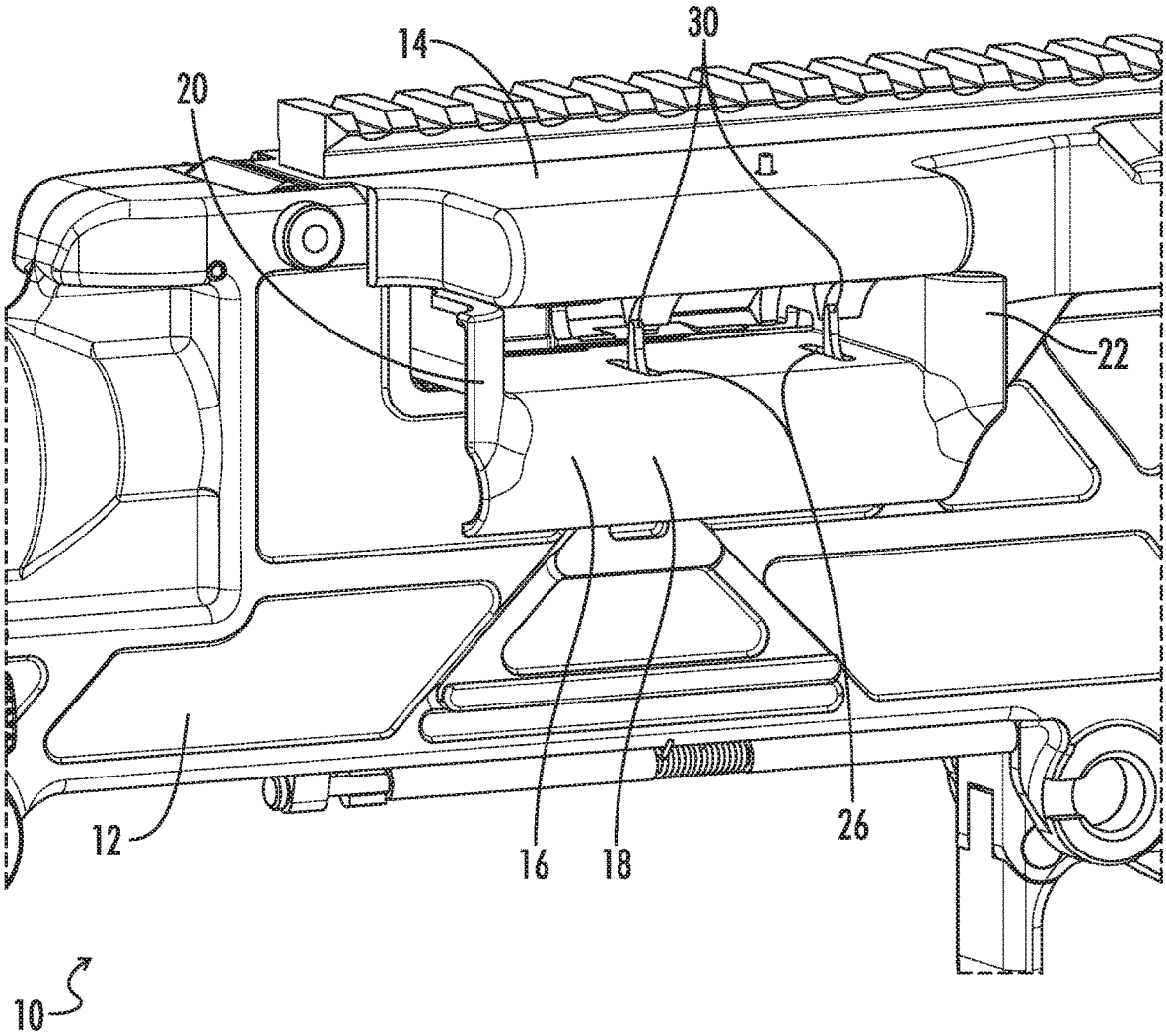
FIG. 1*a* is an illustration of an embodiment of the ammunition retaining feed tray of the firearm illustrated in FIG. 1.

Referring now to FIGS. 1-8, there are illustrations of an ammunition retaining feed tray on a firearm. Generally, the firearm, which in this optional embodiment is an M240 machine gun, is designated by numeral 10. The firearm includes receiver 12 and cover assembly 14 with the feed tray designated by numeral 16. Feed tray 16 includes distal end 20 and proximal end 22, with feed end 18. Generally, proximal end 22 is the portion or side of feed tray 16 which would be nearest to a user's firing shoulder when operating the firearm. Otherwise stated, proximal end 22 of feed tray 16 would also be nearer to the buttstock of the firearm. Distal end 20 is the end of feed tray 16, farther from a user's firing shoulder when operating firearm 10. Otherwise stated, distal end 20 is the end or side of feed tray 16, closer to the muzzle of the firearm. Feed end 18 is the end of feed tray 16 where ammunition belt 32 is fed into the firearm.

Feed tray 16 may include pawl openings 26 to allow pawls 30 to extend above the surface of the feed tray 16 out of pawl openings 26. As described herein below and illustrated in the accompanying figures, pawl openings 26 can also be understood to be designed holes or voids in feed tray 16.

Figure 2A:
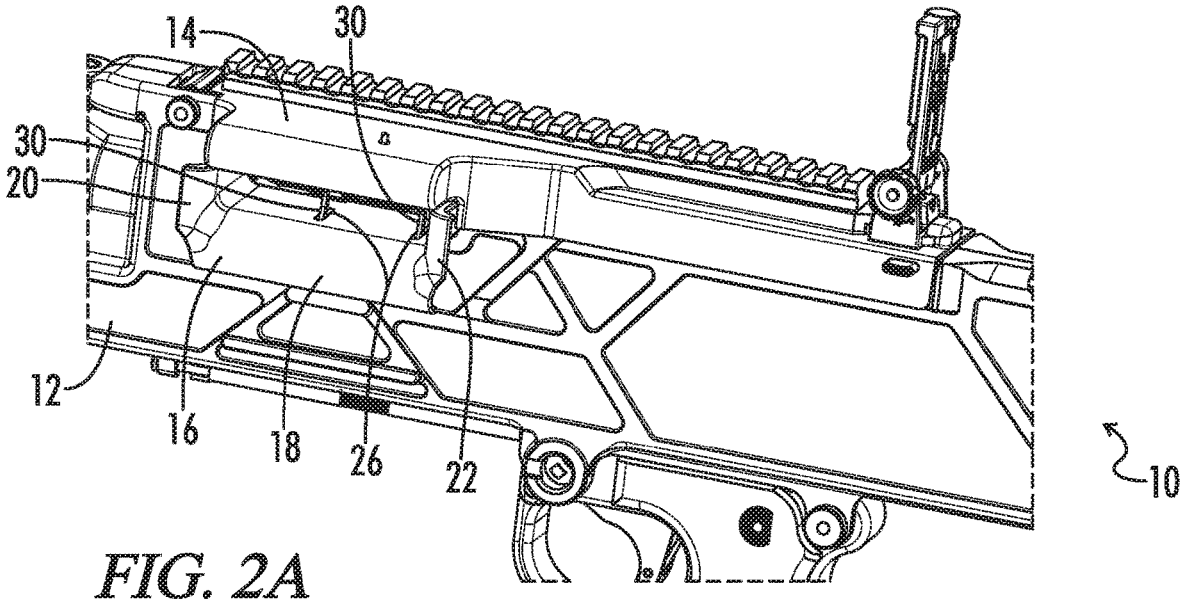
FIG. 2*a* is an illustration of ammunition retaining feed tray with the cover assembly closed on the firearm.
Figure 2B:
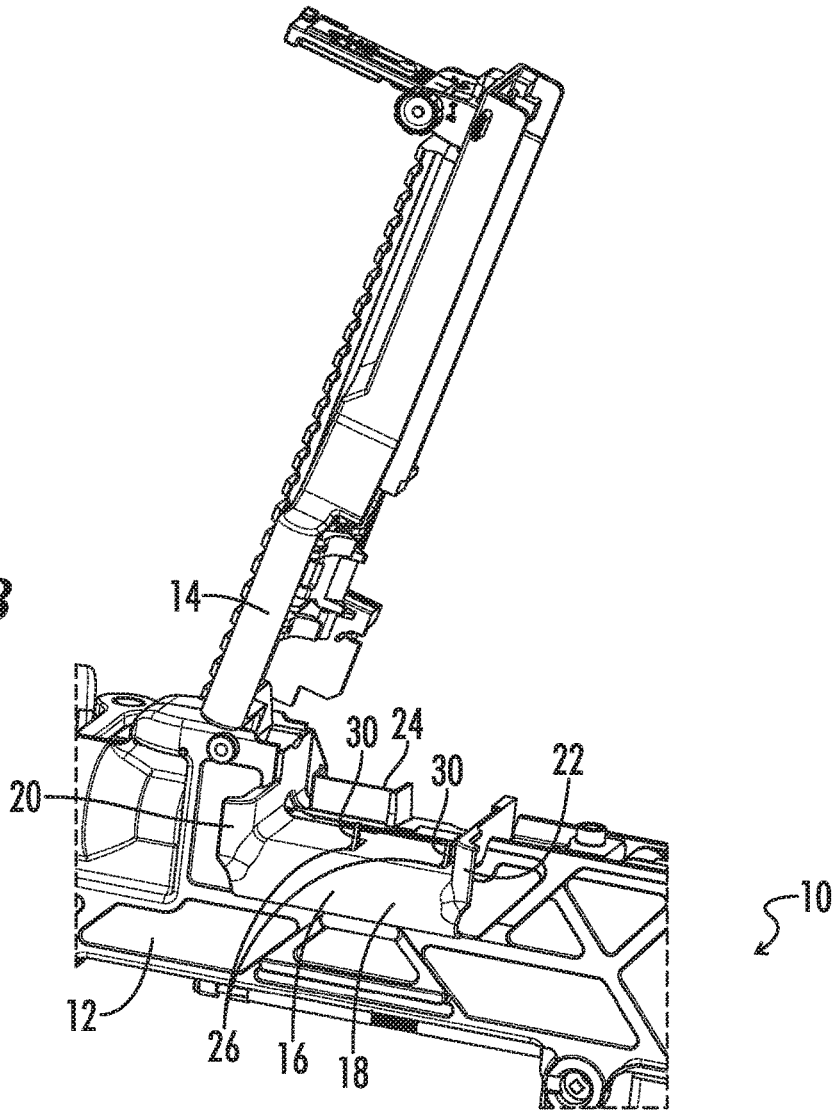
FIG. 2*b* is an illustration of ammunition retaining feed tray with the cover assembly open on the firearm.
Figure 3:
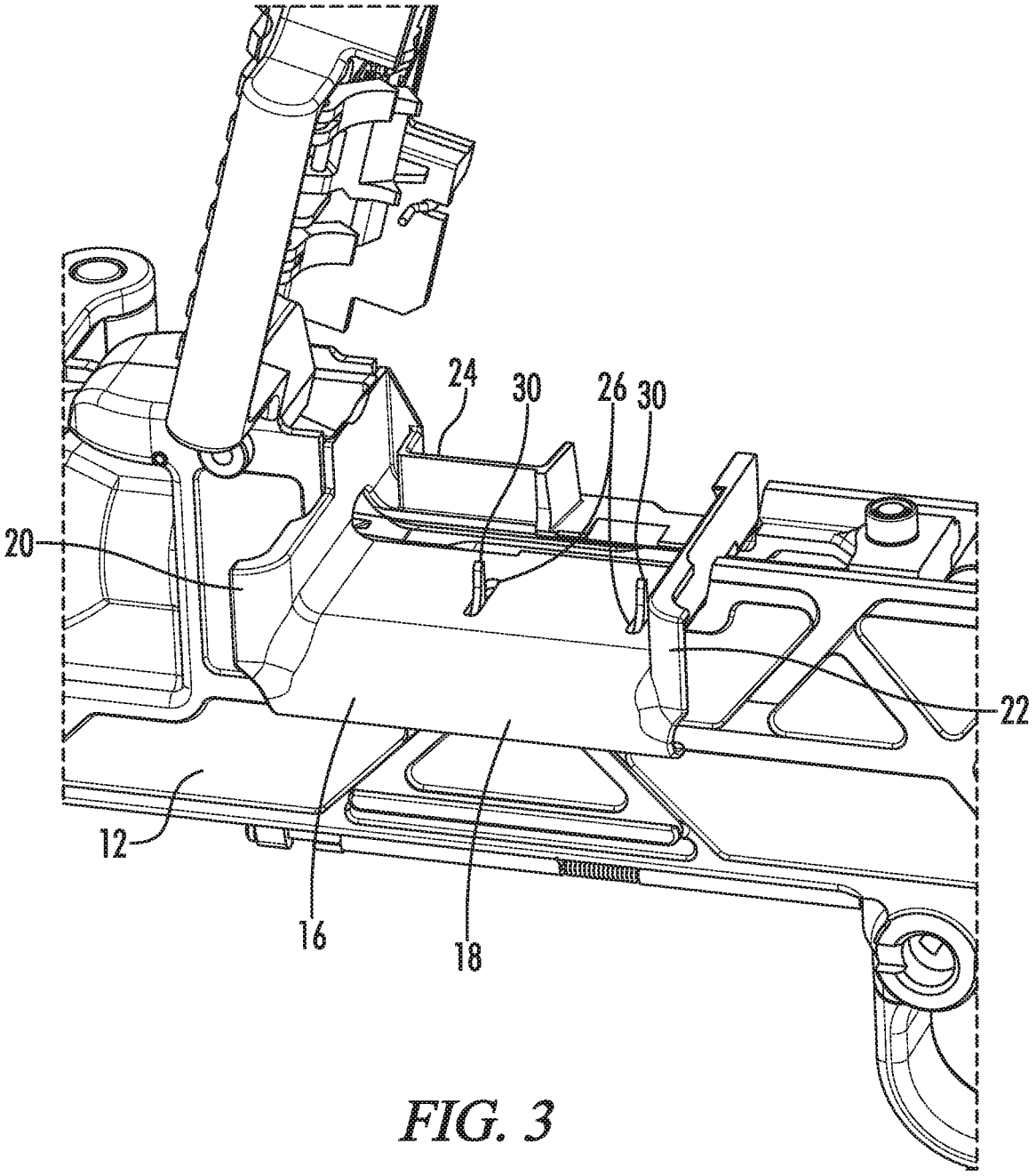
FIG. 3 is a close-up illustration of an ammunition retaining feed tray with a cover assembly open on the firearm.

As is more clearly illustrated in FIG. 2*a* and FIG. 2*b*, cover assembly 14 rotates in a distal direction to allow a user to insert ammunition belt 32 into firearm 10. FIG. 2*b* illustrates cover assembly 14 open to more clearly show feed tray 16. Additionally, cartridge stop 24 is visible opposite feed end 18 of feed tray 16. Cartridge stop 24 functions to assist in aligning ammunition belt 32 on feed tray 16 so that ammunition belt 32 properly feeds into firearm 10. As used herein, "align" may be understood to be mean place a cartridge of ammunition belt 32 adjacent to cartridge stop 24, or alternatively to prevent over insertion of ammunition belt 32 within firearm 10.

Pawls 30 of pawl assembly 28 extend through pawl openings 26 in feed tray 16. In optional embodiments, greater or fewer numbers of pawls may be used to maintain an ammunition belt. As illustrated herein, two pawls 30 may be utilized to retain ammunition belt 32 while loading firearm 10. Pawls 30 extend therethrough pawl openings 26 and retain ammunition belt 32 on feed tray 16 while loading firearm 10. In further optional embodiments, pawl openings 26 may have a variety of shapes to allow for pawls 30 to extend therethrough. In the embodiments as illustrated, pawl openings 26 are generally of an oval or ellipsoid shape but can be circular, rectangular, or take on a variety of other shapes. Furthermore, pawl openings 26 should have a sufficient length for pawls 30 to extend therethrough. Generally, in some embodiments, pawl openings 26 should have a length at least long enough to allow for pawls 30 to rotate into an upward position and also to rotate to a downward position with the pawls about below the surface of feed tray 16.

Distal end 20 of feed tray 16 is generally the end of feed tray 16 nearer the nose ends of cartridges 36 of ammunition belt 32. Proximal end 22 is the side of feed tray 16 closer to the primer ends of cartridges 36 of ammunition belt 32. Generally, feed tray 16 is sized with sufficient distance between distal end 20 and proximal end 22 to allow ammunition belt 32 to fit there within to permit the firearm to operate and expend cartridges 36 of ammunition belt 32. In some optional embodiments, feed tray 16 may have a distance between proximal end 22 and distal end 20 of from about 2.3 inches to about 4 inches, and in some optional embodiments from about 2.8 inches to about 3.5 inches. In some other optional embodiments, the distance between proximal end 22 and distal end 20 of feed tray 16 may generally correspond to the length of the cartridges 36 that form ammunition belt 32 so as to allow ammunition belt 32 to feed into firearm 10.

Figure 4:
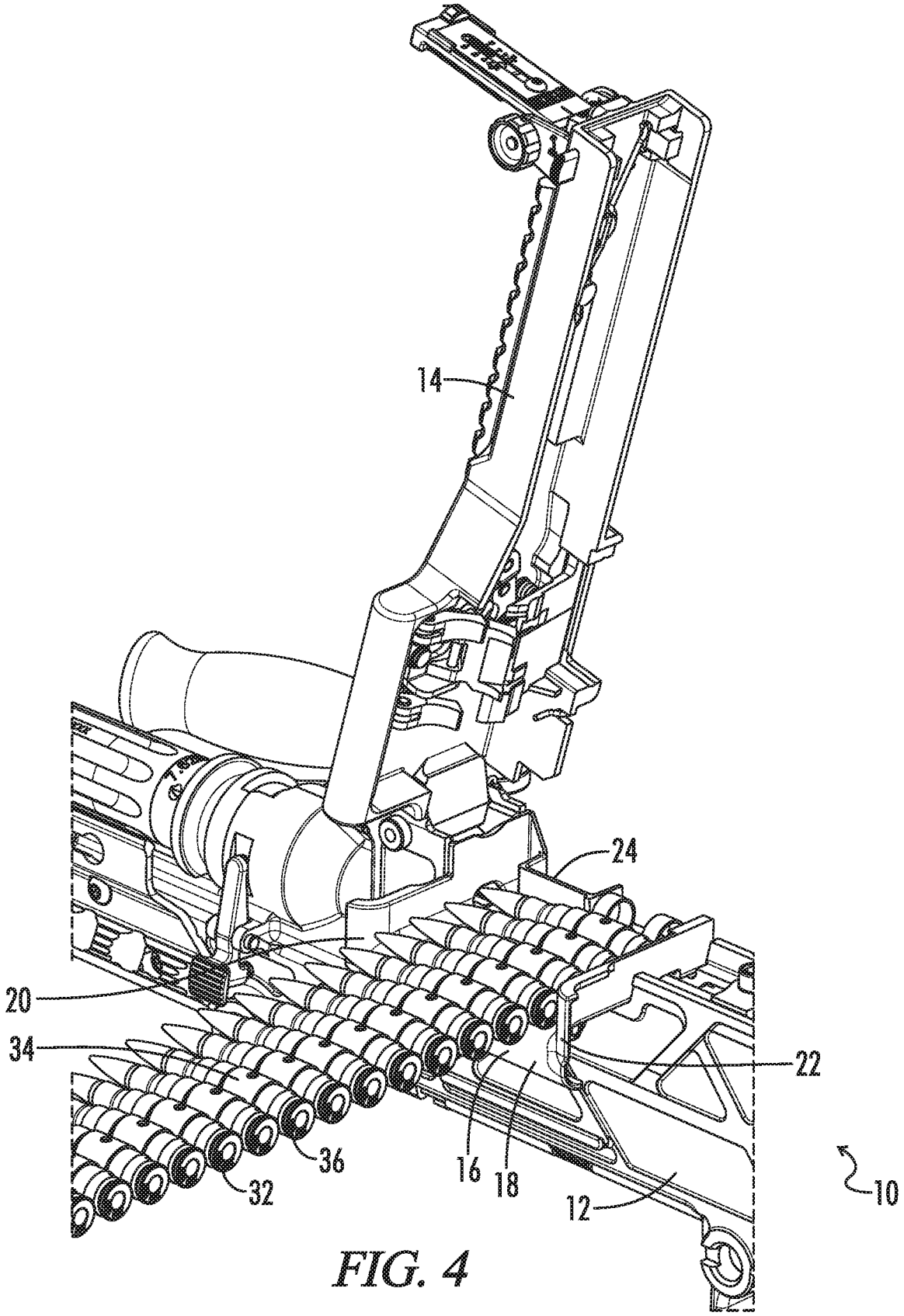
FIG. 4 is an illustration of an ammunition retaining feed tray with an ammunition belt in place and cover assembly open on the firearm.

FIG. 4 is an illustration of firearm 10 with cover assembly 14 open with ammunition belt 32 positioned on feed tray 16. As is illustrated in FIG. 4, ammunition belt 32 is placed upon feed tray 16 from feed end 18 of feed tray 16 with distal end 20 located near the nose ends of cartridges 36 of ammunition belt 32 with proximal end 22 near the primer ends of cartridges 36 of ammunition belt 32. Additionally, pictured are links 34 which connect cartridges 36 in forming ammunition belt 32. In loading an M240 machine gun, cover assembly 14 is opened as illustrated in FIG. 4 and ammunition belt 32 is positioned with a cartridge adjacent to cartridge stop 24.

Figure 5:
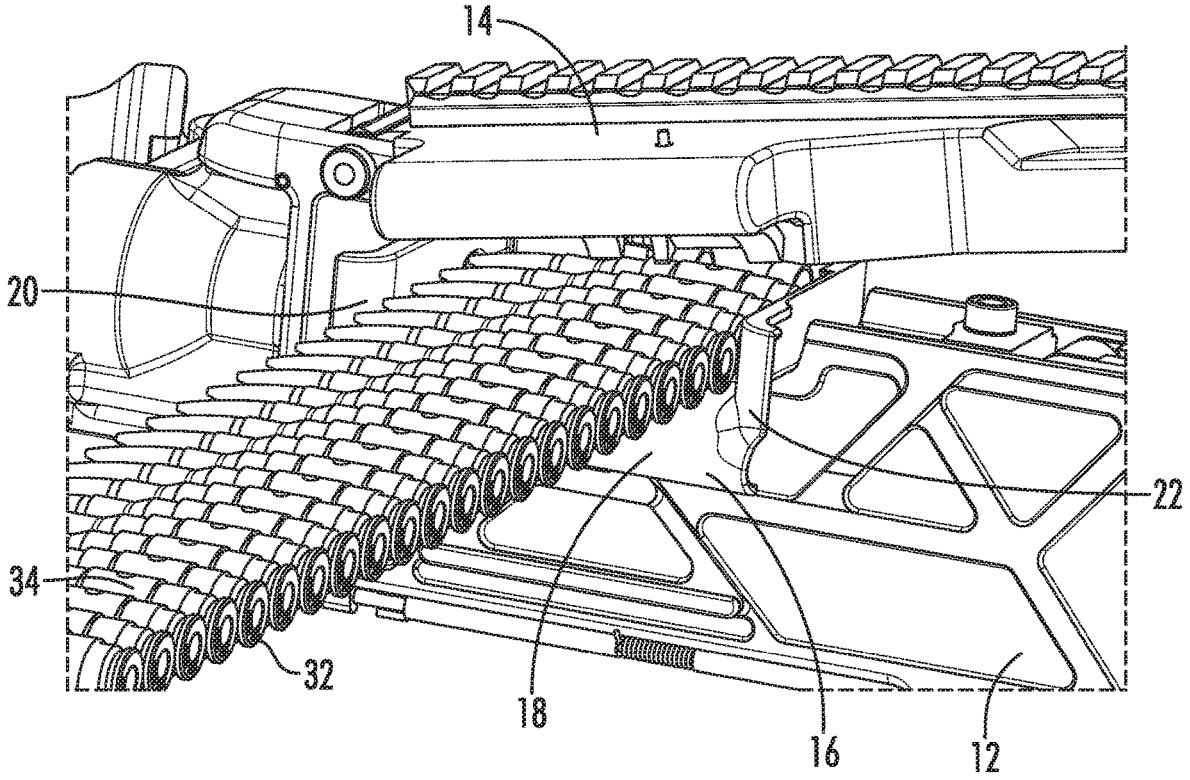
FIG. 5 is an illustration of an ammunition retaining feed tray with an ammunition belt in place and the cover assembly partially open on a firearm.

FIG. 5 provides an illustration of ammunition belt 32 on feed tray 16 with cover assembly 14 partially closed on receiver 12. Here, FIG. 5 illustrated how ammunition belt 32 fits between distal end 20 and proximal end 32 of feed tray 16. Furthermore, for this firearm 10, cover assembly 14 rotates about a rotational connection on the distal end of receiver 12. As should be understood from the illustration of FIG. 5, especially when viewed in conjunction with the multiple other illustrations, is how ammunition belt 32 is desired to stay in place on feed tray 16 while cover assembly 14 is rotated from an open position back to a closed position.

Figure 6:
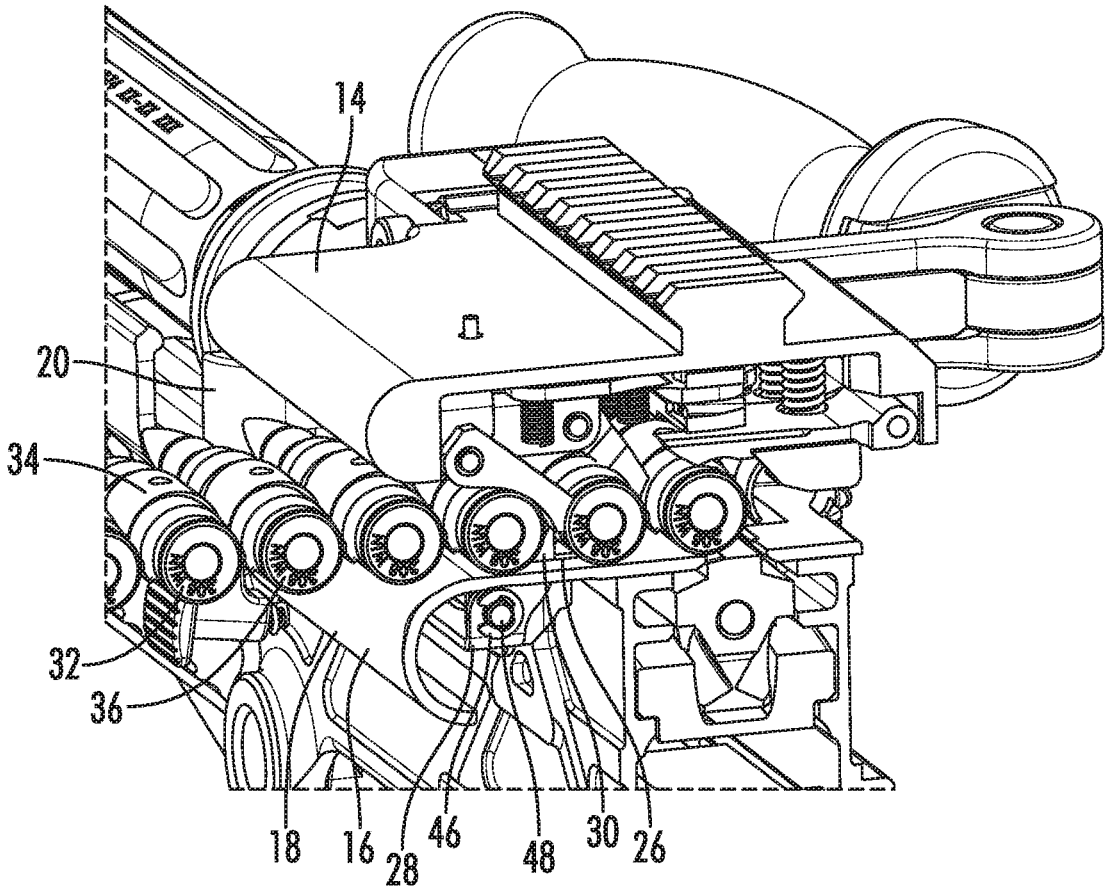
FIG. 6 is a cutaway view illustrating the ammunition retaining feed tray with a cover assembly closed on an ammunition belt.

Referring now to FIG. 6, FIG. 6 provides a cutaway illustration between proximal end 22 of feed tray 16 and the primer ends of cartridges 36 of ammunition belt 32. This view of FIG. 6 allows one to see the engagement of pawls 30 of pawl assembly 28 with ammunition belt 32 on feed tray 16. Pawls 30 fit in the space between individual cartridges 36 of ammunition belt 32. As ammunition belt 32 advances (to the right in FIG. 6) while firearm 10 is being fired, pawls 30 of pawl assembly 28 rotate downward within pawl openings 26 so ammunition belt 32 may continue to advance as firearm 10 is being fired. Otherwise stated, ammunition belt 32 moves in the direction from feed end 18 toward cartridge stop 24 of feed tray 16 with pawls 30 moving or rotating downward to allow cartridges 36 of ammunition belt 32 to advance toward cartridge stop 24. As is provided in the illustrated embodiment, pawls 30 rotate in a generally clockwise direction when viewed from proximal end 22 of feed tray 16 in allowing cartridges 36 of ammunition belt 32 to advance during operation of firearm 10. As cartridges 36 of ammunition belt 32 feed into firearm 10 during firing of firearm 10, cartridges 36 advance from feed end 18 toward cartridge stop 24 and contact the feed end side of pawls 30 and force pawls 30 to rotate downward within pawl openings 26 of feed tray 16. Conversely and as explained hereinafter, force on the cartridge stop side of pawls 30 fails to rotate pawls downward. As used herein, the feed end side of pawls 30 is the side of pawls 30 nearer to the feed end 18 of feed tray 16 whereas the cartridge stop side of pawls 30 is the side of pawls 30 nearer to the cartridge stop 24 of feed tray 16.

Illustrated in FIG. 6, as well as in certain subsequent illustrations, is pawl pin 48 and retaining clip 46. In certain embodiments, pawl pin 48 may be used to connect pawl assembly 28 to pawl assembly engagement 54 of feed tray 16. Generally, pawls 30 rotate about pawl assembly pin 30 in moving from an upward position to a downward position. The use of pawl pin 48 allows for the rotation of pawls 30 from an upward position to a downward position. In certain embodiments, retaining clip 46 is used to secure pawl assembly 28 to feed tray 16. Optionally, retaining clip 46 may be removable from feed tray 16. Advantageously, if a user desired to remove pawl assembly 28 from firearm 10, all a user would have to do is remove retaining clip 46 and pawl pin 48 to remove pawl assembly 28 from feed tray 16 in certain embodiments. Thus, there would be no pawls within pawl openings 30 on feed ramp 16 and thus feed ramp would function similar to a smooth feed ramp.

Figure 7:
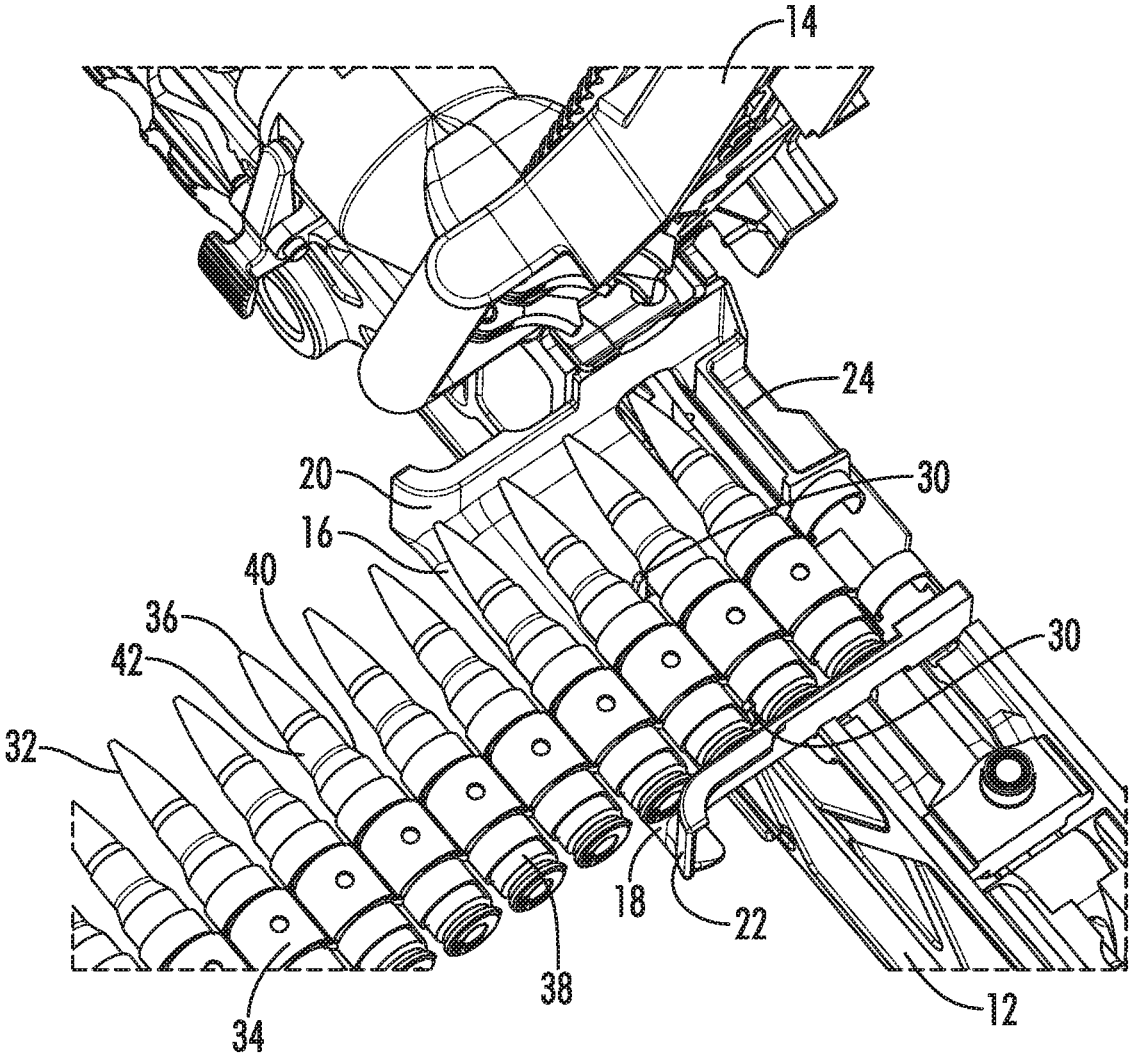
FIG. 7 is a top view illustration of the ammunition retaining feed tray with an ammunition belt in place and with the cover assembly of the firearm open.

FIG. 7 provides an illustration with a bird's eye perspective of ammunition belt 32 on feed tray 16 with cover assembly 14 in an open position. Ammo belt 32 has a cartridge adjacent to cartridge stop 24 and rests upon feed tray 16 with pawls 30 visible between two cartridges of ammo belt 32. Linkage 34 fits within the space between pawls 30, the spacing of the pawls referred to as the pawl span. Additionally, pawls 30 are sized to fit within the space between adjacent cartridges 36, such space generally created by the linkage 34 holding ammunition belt 32 together.

Furthermore, FIG. 7 allows for illustration of various portions of cartridges 36 of ammunition belt 32. Specifically, such have been identified to further illustrate and describe possible orientations of ammunition belt 32 on feed tray 16 with pawl assembly 28. Particularly, cartridge 36 may include body 38, shoulder 40, and neck 42. In the embodiment as described and illustrated, pawls 30 fit between individual cartridges 36 of ammunition belt 32 and pawls 30 are positioned to contact bodies 38 of cartridges 36 as they pass over pawls 30. Otherwise stated, the spacing between pawls 30 allows for linkage 34 to pass between pawls 30 with pawls 30 contacting the individual bodies 38 of cartridges 36 of ammunition belt 32. Such orientation provides for even feeding of ammunition belt 32 to firearm 10. In other optional embodiments, the pawls may be positioned so one or more pawls contacts the neck or shoulder of the cartridges of an ammunition belt. Such optional embodiments would require positioning of the pawls in a different orientation so as to maintain the alignment of the ammunition belt and feeding of cartridges into the firearm during operation of the firearm.

Pawls 30 fit into the space between individual cartridges 36 of ammunition belt 32 and as each cartridge is fired, the ammunition belt moves in the direction from feed end 18 toward cartridge stop 24 with pawls 30 rotating downward as each cartridge 36 passes over pawl openings 26 and feed tray 16. In other words, cartridges 36 of ammunition belt 32 as they move toward cartridge stop 34, push (rotate) pawls 30 in a direction of cartridge stop 24, causing pawls 30 to rotate downward within pawl openings 26 of feed tray 16 as cartridges 36 of ammunition belt 32 are fired. However, pawls 30 preclude ammunition belt 32 in moving in a direction from cartridge stops 24 toward feed end 18 as pawls 30 will not rotate in a downward direction if force is applied in such direction. Otherwise stated, a user may place ammunition belt 32 on feed tray 16 of firearm 10 as illustrated in FIG. 7 without the weight of ammunition belt 32 pulling itself off of feed tray 16. Described differently, pawls 30 resist rotation toward feed end 18 of feed tray 16, thus preventing ammunition belt 32 from sliding off feed tray 16, or otherwise moving in a direction off of feed end 18. Pawls 30 buttress against the edge of pawl openings 30 when force is provided against the cartridge stop side of pawls 30. This maintains pawls 30 in an upward position whereby pawls 30 do not recess into pawl openings 26 of feed ramp 16. Additionally, or alternatively, pawl assembly 28 may buttress against pawl assembly engagement 54 in precluding pawls 30 from rotating from an upward position toward feed end 18 of feed tray 16.

Figure 8:
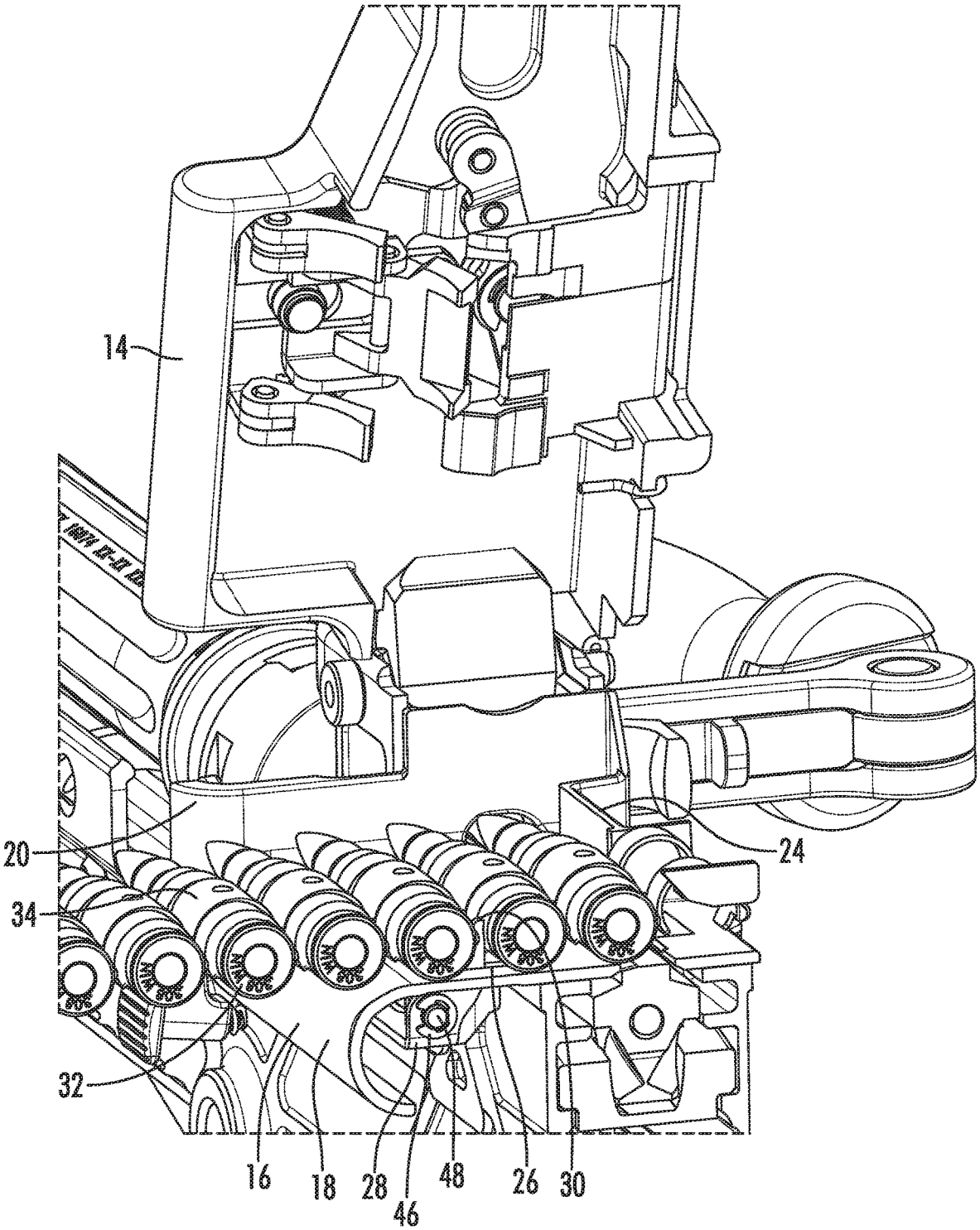
FIG. 8 is a cutaway illustration of the ammunition retaining feed tray with an ammunition belt in place and the top cover of the firearm open.

The cutaway illustration of FIG. 8 provides a closer view of a pawl 30 engaging cartridges 36 of ammunition belt 32. As cartridges of ammunition belt 32 move from left to right, pawl 30 rotates from an upward position in a clockwise manner downward within pawl opening 26 in allowing cartridges 36 and ammunition belt 32 to pass over pawls 30 and pawl openings 26 of feed tray 16. However, even with cover assembly 14 open, ammunition belt 32 will maintain position on feed tray 16 as pawl 30 precludes the cartridge 36 on the cartridge stop side of pawl 30 from moving over pawl 30 as pawl 30 resist rotation toward feed end 18.

Figure 9A:
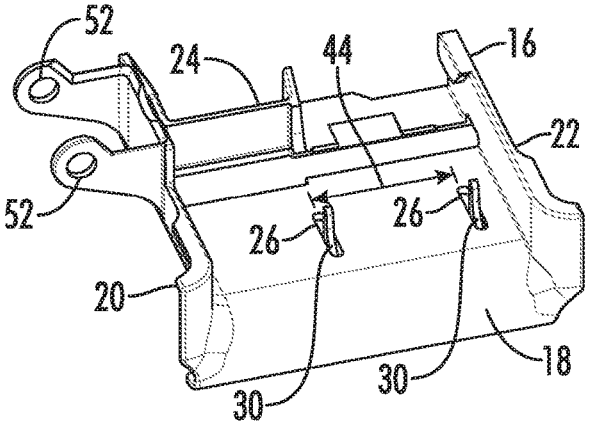
FIG. 9*a* is a top perspective view illustration of an ammunition retaining feed tray separate from the firearm with the pawl assembly attached and the pawls in an upward position.
Figure 9B:
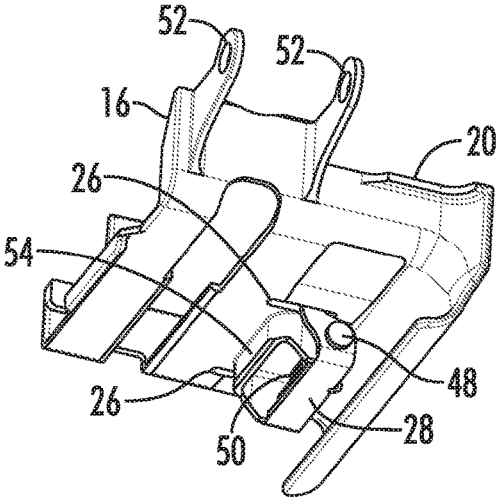
FIG. 9*b* is a bottom perspective view illustration of an ammunition retaining feed tray separate from the firearm with the pawl assembly attached and the pawls in an upward position.

FIGS. 9*a*, 9*b*, 10*a*, and 10*b*, are illustrations of feed tray 16 removed from a firearm with pawl assembly 28 attached. FIGS. 9*a* and 9*b* illustrate pawls 30 in an upward position whereby pawls 30 extends there through pawl openings 26 on feed ramp 26. Biasing member 50 provides force to return pawls 30 to an upward position after pawls 30 has been pushed downward. Furthermore, biasing member 50, can maintain pawls 30 in an upward position as illustrated in FIGS. 9*a* and 9*b* so that a user may easily place an ammunition belt on feed tray 16 with pawls 30 extending upward and thus engaging the ammunition belt. Biasing member 50, may, for example, be a spring biasing member.

The upward position of pawls 30 is understood to be the position where the pawls extend through pawl openings 26. This position may be maintained by biasing number 50 which exerts force against pawl assembly 28 to position pawls 30 through pawl openings 26. One example of an upward position is illustrated in FIGS. 9*a* and 9*b*. In optional embodiments, pawls 30 may extend from about 0.1 inches to about 0.5 inches above pawl opening 30 of feed tray 16 though may be greater or lesser depending on the specific firearm and ammunition belt type. Furthermore, pawls 30 may have a pawl span as designated by numeral 44, which is the distance between the two pawls 30 as illustrated in FIG. 9*a*. Optional embodiments provide for a pawl span of generally less than about 3 inches and in some further optional embodiments of from about 1.2 inches to about 1.6 inches. Feed tray 16 also includes feed tray connection point 52 for connection to receiver 12 of firearm 10. In the embodiment as illustrated with firearm 10, for an M240 machine gun, feed tray 16 may also rotate similarly to cover assembly 14 but via feed tray connection points 52.

Figure 10A:
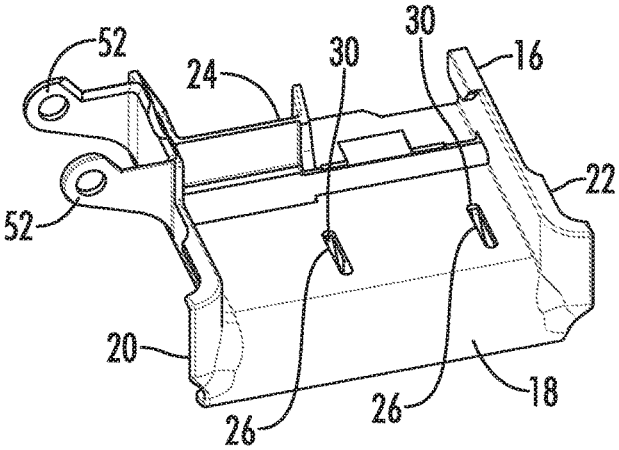
FIG. 10*a* is a top perspective view illustration of an ammunition retaining feed tray separate from the firearm with the pawl assembly attached and the pawls in a downward position.
Figure 10B:
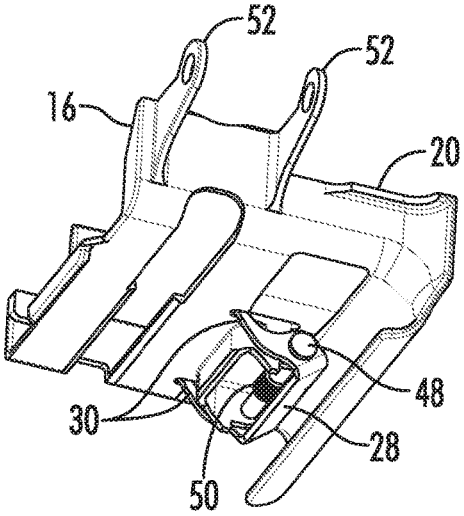
FIG. 10*b* is a bottom perspective view illustration of an ammunition retaining feed tray separate from the firearm with the pawl assembly attached and the pawls in a downward position.

FIGS. 10*a* and 10*b* provide similar orientation as FIGS. 9*a* and 9*b* but with pawls 30 in a downward position. As used and herein, pawls 30 are considered to be in a downward position when they recess downward into pawl openings 26 to allow ammunition belt 32 to pass over. The downward position of pawls 30 is needed for advancement of ammunition belt 32 when operating the weapon when cover assembly 14 is in a closed position on receiver 12 of firearm 10. Depending on the orientation of the pawls and the type of ammunition belt used with the firearm, the pawls may, for example, be positioned to contact a shoulder or a neck of a cartridge in other embodiments. In such optional arrangements, such pawls could be in downward position and allow cartridges to pass over without having to be fully recessed within pawl openings 26. Furthermore, FIG. 10*b* provides a clearer illustration of biasing member 50, as previously described in referenced to FIGS. 9*a* and 9*b*.

Figure 11A:
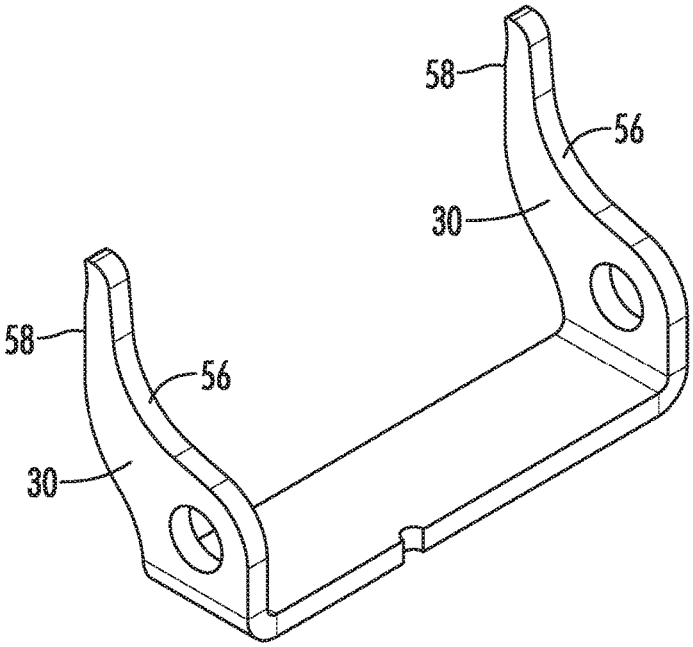
FIG. 11*a* is a perspective view illustration of pawls separate from the pawl assembly and feed tray.
Figure 11B:
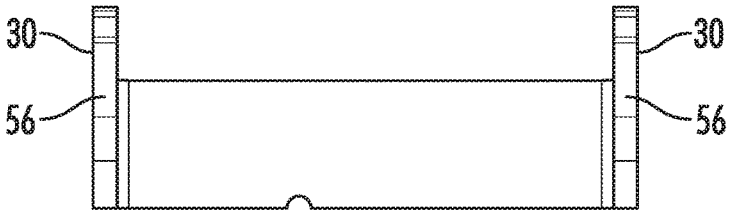
FIG. 11*b* is a top view illustration of pawls separate from the pawl assembly and feed tray.
Figure 11C:
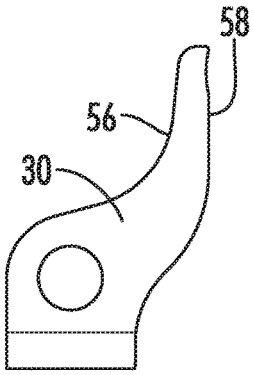
FIG. 11*c* is a side view illustration of pawls separate from the pawl assembly and feed tray.
Figure 11D:
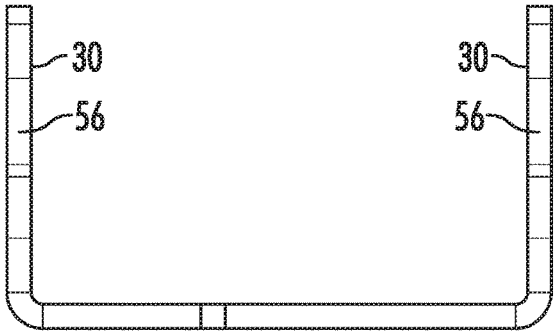
FIG. 11*d* is a side view illustration of pawls separate from the pawl assembly and feed tray.
Figure 11E:
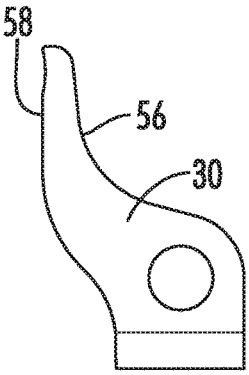
FIG. 11*e* is a side view illustration of pawls separate from the pawl assembly and feed tray.

FIGS. 11*a, b, c, d*, and *e* illustrate two pawls 30 in different orientations and removed from the rest of pawl assembly 28. Pawls 30 may include in optional embodiments curvature on different sides of pawls 30. In the optional embodiments as illustrated in FIGS. 11*a, b, c, d* and *e*, feed end side 56 may include a curvature to aid cartridges 36 of ammunition belt 32 in forcing pawls 30 into a downward position. In optional embodiments, the radius of curvature of feed end side 56 of pawls 30 may be from about 0.15 inches to about 0.5 inches. Cartridge stop side 58 of pawls 30 may also include a curvature to better retain ammunition belt 32 in position on feed tray 16 when cover assembly 14 is open. Such curvature may better help in retaining and preventing ammunition belt 32 from slipping off of feed tray 12. In optional embodiments the curvature on cartridge stop side 58 may be absent or alternatively may have a greater or lesser radius of curvature. In some optional embodiments the radius of curvature of a curve on second edge 58 may be from about 0.15 to about 0.5 inches.

In further optional embodiments, pawls 30 may be a variety of different shapes and sizes, so long as pawls 30 are adequate to retain ammunition belt 32 with cover assembly 14 open. With cover assembly 14 closed, mechanics of cover assembly 14 as well as firearm 10 preclude ammunition belt 32 from slipping off feed tray 16 or out of firearm 10. Thus, as used herein, the term "retain" is also understood to mean maintaining position of ammunition belt 32 on feed tray 16 with cover assembly 14 open with firearm 10 in a generally horizontal position with the barrel and receiver about parallel with the ground.

Generally, a belt-fed firearm as described herein, a user would first open the top cover of a belt-fed firearm and then locate the feed tray of the belt-fed firearm. This optional embodiment would include a feed tray having two pawl openings and a pawl assembly with two pawls operable between an upward position and a downward position, with the feed tray also including a cartridge stop. The user would then place an ammunition belt having cartridges and linkage on the feed tray and adjacent the cartridge stop. In doing so, the user would position the linkage of the ammunition belt between two upwardly positioned pawls with each of the two pawls extending into space between adjacent cartridges of the ammunition belt before closing the cover assembly of the belt-fed firearm.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful ammunition retaining feed tray, it is not intended that such references be construed as limitations upon the scope of this invention except as set forth in the following claims.

What is claimed is:

1. An ammunition retaining feed tray for a firearm comprising:

a feed tray comprising a distal end and a proximal end, a cartridge stop for alignment of an ammunition belt, a first and a second pawl opening, and a pawl assembly engagement; and a pawl assembly connected to the pawl assembly engagement of the feed tray, wherein the pawl assembly comprises a first and a second pawl operable to move between an upward position and a downward position within the first and second pawl opening of the feed tray and for engaging an ammunition belt, a cross member adjoining an end of the first pawl and an end of the second pawl, and a pawl assembly pin about which the first and second pawls are rotatable;

wherein the pawl assembly engagement is located at least partly between the first pawl and the second pawl;

wherein each of the first and second pawls comprises a cartridge stop side configured to contact a cartridge secured to the ammunition belt when the first and second pawls are in the upward position, and a feed end side configured to contact a first surface of an adjacent cartridge secured to the ammunition belt as the adjacent cartridge moves toward the cartridge stop;

wherein at least a portion of the feed end side is curved and conforms to a shape of the first surface of the adjacent cartridge;

wherein the first and second pawls are configured to retain the ammunition belt on the feed tray during firearm loading; and wherein a portion of each of the first and second pawls is positioned between a centerline of the cartridge and a centerline of the adjacent cartridge when the first and second pawls are in the upward position.

2. An M240 machine gun comprising the ammunition retaining feed tray of claim 1.

3. The ammunition retaining feed tray of claim 1 wherein the pawl assembly further comprises a biasing member.

4. The ammunition retaining feed tray of claim 3 wherein the biasing member comprises a spring.

5. The ammunition retaining feed tray of claim 1, wherein at least one of the feed end side and cartridge stop side comprise a curve with a radius of curvature of about 0.15 inches to about 0.5 inches.

6. The ammunition retaining feed tray of claim 1 wherein the first and second pawls have a pawl span of less than about three inches.

7. The ammunition retaining feed tray of claim 6 wherein the pawl span is from about 1.2 inches to about 1.6 inches.

8. The ammunition retaining feed tray of claim 1, wherein:

the pawl assembly is configured to rotate in relation to the feed tray about an axis;

the feed end side of the at least one pawl is configured to contact the surface of the adjacent cartridge secured to the ammunition belt as the adjacent cartridge moves toward the cartridge stop in a first direction; and and the axis of rotation of the pawl assembly and the centerline of the adjacent cartridge have substantially the same position in relation to the feed tray in the first direction.

9. A belt-fed firearm comprising:

a receiver;

a cover assembly; and feed tray with a distal end, a proximal end and a first and a second pawl opening;

the cover assembly and feed tray both connected to the receiver with a pawl assembly adjacent to the feed tray, and the pawl assembly having a first and a second pawl operable to move between an upward position and a downward position within the first and second pawl opening of the feed tray, a cross member adjoining an end of the first pawl and an end of the second pawl, and a pawl assembly pin about which the first and second pawls are rotatable;

wherein a pawl assembly engagement is connected to the pawl assembly and is located at least partly between the first pawl and the second pawl;

wherein each of the first and second pawls comprises a cartridge stop side configured to contact a cartridge secured to an ammunition belt when the first and second pawls are in the upward position, and a feed end side configured to contact a first surface of an adjacent cartridge secured to the ammunition belt as the adjacent cartridge moves toward the cartridge stop;

wherein at least a portion of the feed end side is curved and conforms to a shape of the first surface of the adjacent cartridge;

wherein the first and second pawls are configured to retain the ammunition belt on the feed tray during firearm loading; and wherein a portion of the at least one pawl is positioned between a centerline of the cartridge and a centerline of the adjacent cartridge when the first and second pawls are in the upward position.

10. The belt-fed firearm of claim 9 wherein the at least one pawl is operable to move to an upward position and a downward position.

11. The belt-fed firearm of claim 9 wherein the pawl assembly further comprises a biasing member.

12. The belt-fed firearm of claim 9 further comprising a pawl span of from about 1.2 inches to about 1.6 inches.

13. The belt-fed firearm of claim 9 wherein the receiver comprises an M240 machine gun receiver.

14. The belt-fed firearm of claim 13 wherein the M240 machine gun receiver comprises a unitary first shell and a unitary second shell.

15. A method of loading a belt-fed firearm comprising the steps of:

a) opening a top cover of a belt-fed firearm;

b) locating a feed tray of the belt-fed firearm; the feed tray comprising a first and a second pawl opening, a pawl assembly engagement, and a cartridge stop, wherein the pawl assembly engagement is connected to a pawl assembly comprising a first pawl and a second pawl operable to move between an upward position and a downward position within the first and second pawl openings, a cross member adjoining an end of the first pawl and an end of the second pawl, and a pawl assembly pin about which the first and second pawls are rotatable; wherein: the pawl assembly engagement is located at least partly between the first pawl and the second pawl; each of the first and second pawls comprises a cartridge stop side configured to contact a respective cartridge secured to the ammunition belt when the first and second pawls are in the upward position, and a feed end side configured to contact a first surface of an adjacent cartridge as the adjacent cartridge moves toward the cartridge stop; at least a portion of the feed end side is curved and conforms to a shape of the first surface of the adjacent cartridge; the first and second pawls are configured to retain the ammunition belt on the feed tray during firearm loading; and a portion of each of the first and second pawl is positioned between a centerline of the cartridge and a centerline of the adjacent cartridge when the first and second pawls are in the upward position;

c) placing an ammunition belt having cartridges and linkage on the feed tray and adjacent the cartridge stop;

d) positioning the linkage of the ammunition belt between the first and second upwardly positioned pawls with each of the first and second pawls extending into space between adjacent cartridges of the ammunition belt so as to secure the ammunition belt on the feed tray; and e) closing the top cover after step d).

16. The method of claim 15 wherein the pawls have a feed end side and a cartridge stop side and step d) further comprises retaining the ammunition belt on the feed tray by the cartridge stop sides of the pawls contacting one of the cartridges of the ammunition belt.

17. The method of claim 16 further comprising rotating the pawls to a downward position by contacting the feed end side of the pawls by contact from cartridges of the ammunition belt.

18. An ammunition retaining feed tray for a firearm comprising:

a feed tray comprising a distal end and a proximal end, a cartridge stop for alignment of an ammunition belt, a first and a second pawl opening, and a pawl assembly engagement; and a pawl assembly connected to the pawl assembly engagement of the feed tray and configured to rotate in relation to the feed tray about an axis of rotation, wherein the pawl assembly comprises a first and a second pawl operable to move between an upward position and a downward position within the first and second pawl opening of the feed tray and for engaging an ammunition belt, a cross member adjoining an end of the first pawl and an end of the second pawl, and a pawl assembly pin defining the axis of rotation; wherein:

the pawl assembly engagement is located at least partly between the first pawl and the second pawl;

each of the first and second pawls comprises a cartridge stop side configured to contact a cartridge secured to the ammunition belt when the first and second pawls are in the upward position, and a feed end side having an inwardly-curved portion configured to contact a surface of an adjacent cartridge secured to the ammunition belt as the adjacent cartridge moves toward the cartridge stop in a first direction;

the first and second pawls are configured to retain the ammunition belt on the feed tray during firearm loading; and the axis of rotation of the pawl assembly and a centerline of the adjacent cartridge have substantially the same position in relation to the feed tray in the first direction.

19. The ammunition retaining feed tray of claim 18, wherein the axis of rotation of the pawl assembly is located directly below the centerline of the adjacent cartridge.

20. The ammunition retaining feed tray of claim 18, wherein the axis of rotation of the pawl assembly is vertically aligned with the centerline of the adjacent cartridge.

* * * * *